US012419352B2

(12) United States Patent
Jochnowitz

(10) Patent No.: US 12,419,352 B2
(45) Date of Patent: Sep. 23, 2025

(54) ELECTRICAL HEATING ASSEMBLY FOR HEATING AN AEROSOL-FORMING SUBSTRATE

(71) Applicant: Philip Morris Products S.A., Neuchatel (CH)

(72) Inventor: Evan Jochnowitz, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 1146 days.

(21) Appl. No.: 16/972,168

(22) PCT Filed: Jun. 6, 2019

(86) PCT No.: PCT/EP2019/064768
§ 371 (c)(1),
(2) Date: Dec. 4, 2020

(87) PCT Pub. No.: WO2019/234143
PCT Pub. Date: Dec. 12, 2019

(65) Prior Publication Data

US 2021/0235762 A1 Aug. 5, 2021

(30) Foreign Application Priority Data

Jun. 7, 2018 (EP) ..... 18176602

(51) Int. Cl.
*A24F 40/465* (2020.01)
*A24F 40/10* (2020.01)
(Continued)

(52) U.S. Cl.
CPC ..... *A24F 40/465* (2020.01); *A24F 40/20* (2020.01); *A24F 40/30* (2020.01); *A24F 40/10* (2020.01)

(58) Field of Classification Search
CPC ..... A24F 40/20; A24F 40/46; A24F 40/465; A24F 1/30
See application file for complete search history.

(56) References Cited

U.S. PATENT DOCUMENTS

2007/0102013 A1 5/2007 Adams et al.
2016/0331033 A1 11/2016 Hopps et al.
(Continued)

FOREIGN PATENT DOCUMENTS

CN 101277623 A 10/2008
CN 103653258 A 3/2014
(Continued)

OTHER PUBLICATIONS

Japanese Office Action issued May 11, 2023 in Japanese Patent Application No. 2020-567553 (with English Translation), 6 pages.
(Continued)

*Primary Examiner* — Michael H. Wilson
*Assistant Examiner* — Daniel Edward Vakili
(74) *Attorney, Agent, or Firm* — Oblon, McClelland, Maier &Neustadt, L.L.P.

(57) ABSTRACT

A heating assembly for heating an aerosol-forming substrate is provided, the assembly including a cup-shaped heating chamber to receive the substrate to be heated, the chamber being formed at least by a sleeve portion and a bottom portion that is disposed at a distal end of the chamber opposite to an open proximal end of the chamber; a first electrical heater including at least one first heating element circumferentially arranged around the sleeve portion and being configured to heat the sleeve portion at least to a first temperature; and a second electrical heater including at least one second heating element arranged at an outer end face of the bottom portion and being configured to heat the bottom portion at least to a second temperature. An electrically
(Continued)

heated aerosol-generating device and an aerosol-generating system including the heating assembly are also provided.

13 Claims, 2 Drawing Sheets

(51) Int. Cl.
*A24F 40/20* (2020.01)
*A24F 40/30* (2020.01)

(56) References Cited

U.S. PATENT DOCUMENTS

| | | | | |
|---|---|---|---|---|
| 2017/0055575 | A1* | 3/2017 | Wilke | A24B 15/16 |
| 2017/0055583 | A1 | 3/2017 | Blandino et al. | |
| 2018/0168227 | A1* | 6/2018 | Fraser | A24F 40/465 |
| 2018/0352858 | A1 | 12/2018 | Rojo-Calderon | |
| 2020/0221782 | A1* | 7/2020 | Lim | H05K 1/0203 |
| 2020/0359688 | A1* | 11/2020 | Jang | A24D 1/20 |

FOREIGN PATENT DOCUMENTS

| | | | | | |
|---|---|---|---|---|---|
| CN | 104095291 | A | | 10/2014 | |
| CN | 106455708 | A | | 2/2017 | |
| CN | 206137197 | U | | 5/2017 | |
| CN | 206197012 | U | | 5/2017 | |
| CN | 111655050 | A | | 9/2020 | |
| EP | 3 313 217 | A1 | | 5/2018 | |
| JP | 2020-541572 | A | | 1/2019 | |
| KR | 10-2018-0012459 | | * | 1/2018 | A24F 40/46 |
| KR | 10-2018-0051467 | | * | 5/2018 | A24F 40/51 |
| RU | 2 656 195 | C2 | | 5/2018 | |
| WO | WO 2007/042941 | A2 | | 4/2007 | |
| WO | WO 2015/086318 | A1 | | 6/2015 | |
| WO | WO 2016/207407 | A1 | | 12/2016 | |
| WO | WO 2017/036955 | A2 | | 3/2017 | |
| WO | WO 2017/068095 | A1 | | 4/2017 | |
| WO | WO 2017/194762 | A1 | | 11/2017 | |
| WO | WO 2018/002084 | A1 | | 1/2018 | |
| WO | WO 2018/019543 | A1 | | 2/2018 | |
| WO | WO 2018/064032 | A1 | | 4/2018 | |
| WO | WO 2018/091627 | A1 | | 5/2018 | |
| WO | WO 2019/151687 | A1 | | 8/2019 | |

OTHER PUBLICATIONS

Chinese Office Action issued Jan. 21, 2024 in Chinese Patent Application No. 201980037788.4 (with English Trnaslation0, 14 pages.

International Search Report and Written Opinion issued on Sep. 17, 2019 in PCT/EP2019/064768 filed on Jun. 6, 2019.

Russian Search Report issued Aug. 1, 2022 in Russian Patent Application No. 2020143255 (with English translation). 4 pages.

Combined Chinese Office Action and Search Report issued on Aug. 16, 2023 in Chinese Patent Application No. 201980037788.4 (with unedited computer-generated English translation), 17 pages.

* cited by examiner

ELECTRICAL HEATING ASSEMBLY FOR HEATING AN AEROSOL-FORMING SUBSTRATE

BACKGROUND

The present invention relates to an electrical heating assembly for heating an aerosol-forming substrate. The invention further relates to an electrically heated aerosol-generating device and an aerosol-generating system comprising such a heating assembly.

Aerosol-generating systems based on electrically heating aerosol-forming substrates are generally known from prior art. Typically, these systems comprise two components: an aerosol-generating article including the aerosol-forming substrate to be heated, and an aerosol-generating device comprising a heating chamber for heating the substrate upon receiving the article therein. For this, the device comprises an electrical heater, for example a resistive heater or an inductive heater, which is configured to heat up the heating chamber and, thus, to heat up the aerosol-forming substrate in the article. In many cases, the shape of the article is similar to the shape of conventional cigarettes, that is, substantially rod-shaped or cylindrical, wherein the aerosol-forming substrate typically is located within a distal portion of the article. The heating chamber has a corresponding shape such as to properly receive the article therein. In order to maximize the transfer of thermal energy from the heating chamber to the article the electrical heater is usually arranged circumferentially around the periphery of the heating chamber such as to heat the article all around its circumference at least along the distal portion including the aerosol-forming substrate. The circumference of the article is usually enclosed by a wrapping material and the proximal end of the article usually comprises a filter plug serving as mouthpiece. In contrast, the distal end of the article, that is, the tip end of the article that enters the heating chamber first upon insertion of the article, usually provides the only direct access to the aerosol-forming substrate within the article, in particular for air being drawn through the article during a user's puff. Accordingly, the distal end is a very specific portion of the article, in particular with regard to the user's taste experience.

Therefore, it would be desirable to have a heating assembly, an aerosol-generating device and an aerosol generating system enabling to tap the full potential of this specific area of the article, in particular with regard to a larger variety of a user's taste experience.

BRIEF SUMMARY

According to the invention there is provided a heating assembly for heating an aerosol-forming substrate. The heating assembly comprises a cup-shaped heating chamber for receiving the aerosol-forming substrate to be heated. The substrate may be either directly received within the heating chamber or, preferably, in the form of an aerosol generating article which comprises the aerosol-forming substrate. The heating chamber comprises a sleeve portion and a bottom portion that is arranged at a distal end of the heating chamber opposite to an open proximal end of the heating chamber. Accordingly, the heating chamber is substantially formed at least by the sleeve portion and the bottom portion. The heating assembly further comprises a first electrical heater including at least one first heating element that is circumferentially arranged around the sleeve portion for heating the sleeve portion at least to a first temperature. The heating assembly further comprises a second electrical heater including at least one second heating element that is arranged at an outer end face of the bottom portion for heating the bottom portion at least to a second temperature.

According to the invention it has been recognized that using a second electrical heater at the bottom of the cup-shaped heating chamber enables to selectively heat the distal end of the article at a temperature that is preferably different than a temperature to which the other parts of the article are substantially heated by the first electrical heater. Accordingly, the second temperature preferably is different from the first temperature, in particular higher than the first temperature. However, it is also possible that the second temperature is lower than the first temperature. Having the capability of heating different parts of the article to different temperatures allows for having different aerosol-forming substrate and/or different materials inside the article, for example one in a distal end portion of the article and another one in tubular periphery portion of the article each having a specific temperature for releasing their specific flavor and/or aerosol. Hence, by properly selecting the heating temperatures and operation time of the first and second heater for different portions, different aerosol-forming substrates may be activated at a specifically desired time, with a specifically desired intensity and/or for a specifically desired duration. Advantageously, this enables to provide a much richer taste experience to a user. Of course, it is also possible that the second temperature is equal to the first temperature.

Preferably, the first and second electrical heaters are configured for being operated independently from each other. That is, the first and second heaters preferably are separate and independent heaters. Advantageously, this increases the variety of operation modes of the heating assembly and thus variety of the user experience. In particular, independent operation of the first and second heaters allows for sequentially heating different portions of the article including different aerosol-forming substrates dedicated to different flavors. Each one of the first and second electrical heaters may be associated to or be run by a respective controller which is configured to control operation of the respective heater independently from the respective other heater and controller. The respective controller may be either part of the heating assembly, in particular of the first and second heater, or part of an aerosol-generating device the heating assembly is part of. Of course, it is also possible, that the heating assembly or the aerosol-generating device comprises a single, in particular overall controller which is configured to independently control operation of the first and second heater. In the latter case, the overall controller may comprise controller sub-units, each of which is dedicated to and configured to control one of the first and second heaters. The overall controller may be also used to control other operations, for example recharging of a power supply of the aerosol-generating device.

Alternatively, the first and second heaters may be configured to be commonly operated. In particular, the first and second heaters may be associated to a common controller configured to control operation of the first and second heater simultaneously. The first and second electrically heater may be, for example, operated by the common controller in parallel or serial connection. The common controller may be either part of the heating assembly or part of an aerosol-generating device the heating assembly is part of. As explained above, the common controller may be part of or may be an overall controller of the aerosol-generating device.

In case of common operation, heating of the sleeve portion to a first temperature and heating of the bottom portion to a second temperature, in particular heating of the sleeve portion and the bottom portion to different temperatures, may be achieved by having the first heater and second heater being configured or built differently. Additionally or alternatively, the sleeve portion may include a first material and the bottom portion may include a second material different from the first material such as to allow for heating the sleeve portion and the bottom portion to different temperatures. This will be explained in further detail below.

The first electrical heater may include only one first heating element that is circumferentially arranged around the sleeve portion. Preferably, this single first heating element is arranged around the sleeve portion substantially along the entire axial length extension of the sleeve portion. Alternatively, the first electrical heater may include a plurality of first heating elements. Preferably, each one of the plurality of first heating elements is associated to, in particular circumferentially arranged around a respective sub-portion, in particular axial sub-portion of the sleeve portion. Even more preferably, each sub-portion may be heated by its associated first heating element independently from the other sub-portions of the sleeve portion. Likewise, the second electrical heater may include only one second heating element that is arranged at an outer end face of the bottom portion. Preferably, this single second heating element is arranged across the entire end face of the bottom portion. Alternatively, the second electrical heater may include a plurality of second heating elements. Preferably, each one of the plurality of second heating elements is associated to a respective sub-portion of the sleeve portion. Even more preferably, each sub-portion may be heated by its associated second heating element independently from the other sub-portions of the bottom portion. Advantageously, having a plurality of first and/or second heating elements allows for more complex heating sequences and/or to use articles with a plurality of different substrate sub-portions associated to different flavors. Advantageously, this enables to further increase the variety of user experiences.

In general, each one of the first and the second electrical heater may be either a resistive heater or an inductive heater. That this, the first heater may be a resistive heater and the second heater may be an inductive heater, or the first heater may be an inductive heater and the second heater may be a resistive heater, or the first heater may be an inductive heater and the second heater may be an inductive heater, or the first heater may be a resistive heater and the second heater may be a resistive heater.

As regards resistive heating, the first heater and the second heater may comprise a first and second resistive heating element, respectively. That is, the first heating element and the second heating element, respectively, may be a resistive heating element. The resistive heating element may comprise at least one of a resistive heating wire, a resistive heating track, a resistive heating grid or a resistive heating mesh. For example, the resistive heating element may be a metal track, for example made of platinum, coated or attached to the outer surface of the sleeve portion or the bottom portion of the heating chamber, respectively. In order to maximize the heating capacity, the metal track may be meander-like or spiral-like.

As used herein, the term "resistive heating", also known as Joule heating, refers to the processes by which passage of an electrical current through an electrically conductive material produces heat. Accordingly, in case of a resistive heater, the first or second resistive heating element, respectively, includes or consists of an electrically conductive material having a certain resistivity. Preferably, the resistivity is at least 1.0×10E−08 Ohm-meter, in particular at least 2.5×10E−08 Ohm-meter, measured at room temperature (20° C.).

The electrically conductive material may be one of platinum, aluminum, copper or stainless steel.

As regards inductive heating, the first heater and the second heater may comprise a first and second inductive heating element, respectively. In particular, the first heating element may comprise a first induction coil and the sleeve portion may include or consist of an inductively heatable material. Likewise, the second heating element may comprise a second induction coil and the bottom portion may include or consist of an inductively heatable material.

As used herein, the term "inductively heatable material" refers to a material that is capable to convert electromagnetic energy into heat when located in an alternating electromagnetic field. In general, this may be the result of hysteresis losses and/or eddy currents induced by the alternating electromagnetic field within the inductively heatable material, depending on the electrical and magnetic properties of the material. Hysteresis losses occur in ferromagnetic or ferrimagnetic materials due to magnetic domains within the material being switched under the influence of an alternating electromagnetic field. Eddy currents may be induced, if the material is electrically conductive. In case of an electrically conductive ferromagnetic or ferrimagnetic material, heat can be generated due to both, eddy currents and hysteresis losses. Accordingly, the inductively heatable material of the first heating element and the second heating element, respectively, may be heatable due to at least one of hysteresis losses or eddy currents. Accordingly, the inductively heatable material of the first heating element and the second heating element, respectively, may be at least one of electrically conductive and magnetic, that is, ferromagnetic or ferrimagnetic. For example, the first and/or second heating element may comprise or consist of an electrically conductive paramagnetic or ferromagnetic material, in particular metal, for example ferromagnetic stainless steel or aluminum. Alternatively, the first and/or second heating element may comprise or consist of an electrically conductive ceramic material, such as lanthanum-doped strontium titanate, or yttrium-doped strontium titanate. Likewise, the first and/or second heating element may comprise or consist of an open-porous ferrimagnetic or ferromagnetic ceramic material, such as a ceramic ferrite.

The first and second induction coil may have a shape substantially matching the shape of the sleeve portion and the bottom portion, respectively. In general, each one of the first and second induction coils may be a helical coil or a flat spiral coil, in particular a flat pancake coil or a "curved" planar coil. Use of a flat spiral coil allows for compact design that is robust and inexpensive to manufacture. Use of a helical induction coil advantageously allows for generating a homogeneous alternating electromagnetic field. As used herein a "flat spiral coil" means a coil that is generally planar coil, wherein the axis of winding of the coil is normal to the surface in which the coil lies. The flat spiral induction can have any desired shape within the plane of the coil. For example, the flat spiral coil may have a circular shape or may have a generally oblong or rectangular shape. However, the term "flat spiral coil" as used herein covers both, coils that are planar as well as flat spiral coils that are shaped to conform to a curved surface. For example, the induction coil may be a "curved" planar coil arranged at the circumference of a preferably cylindrical coil support, for example ferrite core. Furthermore, the flat spiral coil may comprise for example two layers of a four-turn flat spiral coil or a single layer of four-turn flat spiral coil.

Preferably, the first induction coil—if present—is a helical coil circumferentially arranged around the sleeve portion or a "curved" planar coil circumferentially arranged around the sleeve portion and shaped to conform to the curved surface of the sleeve portion. The second induction coil—if present—preferably is a helical coil or a flat pancake coil arranged at an outer end face of the bottom portion for heating the bottom portion.

The first and/or second induction coil can be held within one of a housing of the heating assembly, or a main body or a housing of an aerosol-generating device which comprises the heating assembly. The first and/or second induction coil may be wound around a preferably cylindrical coil support, for example a ferrite core.

Preferably, the aerosol-generating device comprises a thermal insulator between the heating chamber and the outer surface the housing. Advantageously, this avoids overheating of the housing and/or undesired burn hazards. In case of the heating assembly involves inductive heating, the thermal insulator preferably is made of an electrically non-conductive and paramagnetic or diamagnetic material, such as to prevent any undesired inductive heating of the thermal insulator.

Preferably, the first and second induction coils do not need to be exposed to aerosol generated during heating. Thus, deposits on the coils and possible corrosion can be prevented. In particular, the first induction coil and the second induction coil, respectively, may comprise a protective cover or layer.

To enhance conversion of energy provided by the electromagnetic field into heat, a minimum distance between the first induction coil and the sleeve portion, or between the second induction coil and the bottom portion preferably is in the range of 0.05 millimeter to 0.3 millimeter, in particular of 0.1 millimeter to 0.2 millimeter.

Preferably, the first and second heaters are both inductive heaters as inductive heating is highly efficient. Accordingly, the first heating element may comprise a first induction coil and the sleeve portion may comprise or consist of an inductively heatable material, and the second heating element may comprise a second induction coil and the bottom portion may comprise or consist of an inductively heatable material, too. In order to achieve heating of the bottom portion and the sleeve portion to different temperatures, an inductance of the first induction coil may be different from an inductance of the second induction coil. In particular, the first induction coil may have a different geometry than the second induction coil. For example, the first induction coil may be a helical coil arranged around the sleeve portion, whereas the second induction coil may be a flat pancake coil arranged at an altering end face of the bottom portion. Alternatively or additionally, the first induction coil and the second induction coil may be different with regard to the number of turns such that the respective alternating electromagnetic fields generated by the first and second induction coil are different causing eddy currents and/or hysteresis losses being different in the sleeve portion and the bottom portion of the heating chamber.

Alternatively or in addition to different inductances of the first and second induction coils, the inductively heatable materials of the bottom portion and the sleeve portion may be different, also causing the heat generation due to eddy currents and/or hysteresis losses being different in the sleeve portion and the bottom portion of the heating chamber. Thus, different temperatures can be achieved even in case the first and second induction coils are similar and operated under the same conditions, that is, generate similar electromagnetic fields within the sleeve portion and the bottom portion.

Even more generally and with regard to both, inductive heating as well as resistive heating, the sleeve portion may include a first material and the bottom portion may include a second material that is different from the first material such as to achieve different heating temperatures in the sleeve portion and the bottom portion due to a difference in the material depending heating mechanism. As to this, at least one of an electrical resistivity, a magnetic permeability or a specific heat of the first material of the sleeve portion is different from an electrical resistivity, a magnetic permeability or a specific heat of the second material of the bottom portion, respectively.

The cup-shaped heating chamber may further comprise a thermally insulating material, for example a thermally insulating ring, which is arranged between the sleeve portion and the bottom portion. Advantageously, this prevents the temperature of the sleeve portion to interfere with the temperature of the bottom portion of the heating chamber. In this configuration, there may be an axial gap or distance between the first heating element and the second heating element at the axial position of the thermally insulating material or ring. As used herein, the term "axial" refers to a length axis of the cup-shaped heating chamber.

In addition, the heating assembly may comprise a heating blade configured to be inserted into the aerosol-forming substrate of an aerosol-generating article. The heating blade may be attached to the inner surface of the bottom portion and may extend into the inner void of the heating chamber substantially along a center axis of the heating chamber. The heating blade may be tapered at its free end such as to facilitate insertion into the substrate of an aerosol-generating article. The blade may be in thermal contact with the bottom portion such as to be heated via thermal conduction from the bottom portion which in turn is heatable by the second heater. Alternatively or additionally, the heating blade may comprise a separate heater, such a resistive heater. The resistive heater may comprise a metal track, for example made of platinum, coated or attached to the surface of the heating blade. The separate heater of the heating blade may be operated by a separate controller or by a common controller already used for controlling the first and second heater, or by an overall controller of an aerosol-generating device the heating assembly is part of. Preferably, the separate heater of the heating blade is configured to be operated independently from the first and/or second heater. Preferably, the heating blade may comprise a metallic core member. In case of being heated by a separate heater, the heating blade may further comprise two ceramic cover members sandwiching the metallic core member. The outer surfaces of at least one cover member may be coated with a resistive heater, for example a metal track.

In case the bottom portion of the heating chamber is to be heated to a higher temperature than the sleeve portion, the first heating element being arranged around the sleeve portion may axially extend towards or up to or even beyond the sleeve portion, in particular such as to surround the bottom portion. As a result, at least a portion of the heat energy provided by the first heater adds to the heat energy provided by the second heater in the bottom portion. In this configuration, the cup-shaped heating chamber preferably does not comprise any thermally insulating ring or thermally insulating material between the sleeve portion and the bottom portion.

In general, the heating chamber may be cylindrical or frustum-shaped. The heating chamber may have different cross-sectional shapes, in particular rectangular, quadratic, circular, oval, triangular, podiatric or star-shaped, polyhedral. As to this, the effective heating surface of the heating chamber increases with an increasing circumferential length of the cross-sectional shape.

Furthermore, at least one of the bottom portion or the sleeve portion may be fluid permeable, in particular comprises at least one opening or channel and/or is perforated. Advantageously this allows passing air from the outside of the heating chamber through the bottom portion and/or the sleeve portion towards the aerosol-forming substrate within the heating chamber. Thus, the heating chamber may be in fluid communication with or part of an air path extending through the heating assembly or through an aerosol-generating device the heating assembly is part of. In case the aerosol-forming substrate substantially rests of the bottom portion of the cup-shaped heating chamber, a perforated bottom portion may connect the aerosol-forming substrate at the distal end of the article with air from the outside of the heating chamber.

In case the aerosol-generating article has lateral air inlets at its circumference, for example going through a wrapping material of the article, the heating chamber may also comprise perforations, openings or channels through the sleeve portion which are arranged such as to be located next to the air inlets in the article when being received in the heating chamber. Thus, air can also laterally pass into the article through its circumference.

In addition or alternatively, at least the sleeve portion and preferably also the bottom portion and—if present—preferably also the thermally insulating material/ring of the heating chamber may comprise a plurality of slots or grooves at their respective inner surfaces which extend from the proximal end of the heating chamber to the bottom portion and preferably further along the bottom portion such as to provide a plurality of airflow passages between the proximal end of the heating chamber and the inner surface of the bottom portion facing the distal end of the article when being inserted into the heating chamber. Accordingly, when a user puffs on the proximal end of the article, ambient air is drawn in at the proximal end of the heating chamber such as to further pass along the plurality of slots or grooves into the article at its distal end. Thus, when passing along the plurality of slots or grooves, the ambient air may be preheated by the sleeve portion and the bottom portion which beneficially affects aerosol formation.

As mentioned above, the first and second heater may be operated by single controllers or a common controller or an overall controller. Such controllers may be either part of the heating assembly or of an aerosol-generating device comprising the heating assembly. In particular the controllers may be configured to provide a driving current (DC or AC) for driving the resistive and/or inductive heaters. In case of induction heating, the respective controller may comprise an induction source, in particular an AC generator, configured to provide an alternating electrical current (AC).

Furthermore, there may be provided at least one power supply for powering the first and second heater. Preferably, the at least one power supply is operatively coupled to the first and second heater via a respective controller. The electrical power supply may be part of electrical heating assembly. Alternatively, the electrical heating device may be part of the aerosol-generating device which the heating assembly of the invention is provided for. Regardless of whether the electrical power supply is part of the aerosol-generating device or the heating assembly, the electrical power supply may be also used for other purposes, for example to run a controller of the heating assembly or an overall controller of the aerosol-generating device.

According to the invention there is also provided an electrically heating aerosol-generating device comprising a heating assembly according to the invention and as described herein.

As used herein, the term "aerosol-generating device" is used to describe an electrically operated device that is capable of interacting with at least one aerosol-forming substrate, in particular with an aerosol-forming substrate provided within an aerosol-generating article, such as to generate an aerosol by heating the substrate. Preferably, the aerosol-generating device is a puffing device for generating an aerosol that is directly inhalable by a user thorough the user's mouth. In particular, the aerosol-generating device is a hand-held aerosol-generating device.

As mentioned before, the aerosol-generating device may comprise at least one controller for controlling operation of the first and second heater of the heating assembly. In particular, the aerosol-generating device may comprise a common controller or separate controllers for controlling operation of the first and second heater. Such controllers may be provided in an overall controller of the aerosol-generating device. Any of these controllers may comprise a microprocessor, for example a programmable microprocessor, a microcontroller, or an application specific integrated chip (ASIC) or other electronic circuitry capable of providing control. Such controllers may comprise further electronic components, such as at least one DC/AC inverter and/or power amplifiers, for example a Class-D or Class-E power amplifier. In particular, such controllers may be configured to regulate a supply of current to the first and/or second heater, for example to the first and/or second induction coil, or to a first and/or second resistive heating element. Current may be supplied to the first and/or second heater continuously following activation of the system or may be supplied intermittently, such as on a puff by puff basis.

With regard to inductive heating, the aerosol-generating device may comprise a common induction source or separate induction sources for powering the first and second induction coils. Preferably, the induction source(s) is/are part of an overall controller of the aerosol-generating device. The induction source(s) may comprise an alternating current (AC) generator. The AC generator may be powered by a power supply of the aerosol-generating device. The AC generator is operatively coupled to the induction coil of the first and/or second heater. The AC generator is configured to generate a high frequency oscillating current to be passed through the induction coil for generating an alternating electromagnetic field. As used herein, a high frequency oscillating current means an oscillating current having a frequency between 500 kHz and 30 MHz, preferably between 1 MHz and 10 MHz and more preferably between 5 MHz and 7 MHz, most preferably at about 6.8 MHz.

As also mentioned before, the aerosol-generating device advantageously comprises a power supply, preferably a battery such as a lithium iron phosphate battery. As an alternative, the power supply may be another form of charge storage device such as a capacitor. The power supply may require recharging and may have a capacity that allows for the storage of enough energy for one or more user experiences. For example, the power supply may have sufficient capacity to allow for the continuous generation of aerosol for a period of around six minutes or for a period that is a multiple of six minutes. In another example, the power supply may have sufficient capacity to allow for a predetermined number of puffs or discrete activations of the induction coil.

The heating chamber of the heating assembly may be embedded in a housing of the aerosol-generating device. In addition to the main body including the controller(s) and the power supply, the aerosol-generating device may further comprise a mouthpiece. The mouthpiece may be mounted to the main body of the device. In particular, the mouthpiece may be configured to close the heating chamber upon mounting the mouthpiece to the main body. For attaching the mouthpiece to the main body, a proximal end portion of the main body may comprise a magnetic or mechanical mount, for example, a bayonet mount or a snap-fit mount, which engages with a corresponding counterpart at a distal end portion of the mouthpiece. In case the device does not comprise a mouthpiece; the aerosol-generating article may comprise a mouthpiece, for example a filter plug.

The aerosol-generating device may comprise at least one air outlet, for example, an air outlet in the mouthpiece (if present).

Preferably, the aerosol-generating device comprises an air path extending from the at least one air inlet through the heating chamber, and possibly further to an air outlet in the mouthpiece, if present.

Further features and advantages of the aerosol-generating device according to the invention have been described with regard to heating assembly according to the present invention and as described herein. Therefore, these further features and advantages will not be repeated.

According to yet another aspect of the invention there is provided an aerosol-generating system. The system comprises a heating assembly or an aerosol-generating device according to the invention and as described herein. The system further comprises an aerosol-generating article receivable in the heating chamber of the heating assembly. The article includes at least one aerosol-forming substrate to be heated.

As used herein, the term "aerosol-generating article" refers to an article comprising at least one aerosol-forming substrate that, when heated, releases volatile compounds that can form an aerosol. Preferably, the aerosol-generating article is a heated aerosol-generating article. That is, an aerosol-generating article which comprises at least one aerosol-forming substrate that is intended to be heated rather than combusted in order to release volatile compounds that can form an aerosol. The aerosol-generating article may be a consumable, in particular a consumable to be discarded after a single use. For example, the article may be a cartridge including a liquid aerosol-forming substrate to be heated. Alternatively, the article may be a rod-shaped article, in particular a tobacco article, resembling conventional cigarettes.

As used herein, the term "aerosol-forming substrate" relates to a substrate capable of releasing volatile compounds that can form an aerosol upon heating the aerosol-forming substrate. The aerosol-forming substrate is part of the aerosol-generating article. The aerosol-forming substrate may be a solid or, preferably, a liquid aerosol-forming substrate. In both cases, the aerosol-forming substrate may comprise at least one of solid and liquid components. The aerosol-forming substrate may comprise a tobacco-containing material containing volatile tobacco flavor compounds, which are released from the substrate upon heating. Alternatively or additionally, the aerosol-forming substrate may comprise a non-tobacco material. The aerosol-forming substrate may further comprise an aerosol former. Examples of suitable aerosol formers are glycerine and propylene glycol. The aerosol-forming substrate may also comprise other additives and ingredients, such as nicotine or flavourants. The aerosol-forming substrate may also be a paste-like material, a sachet of porous material comprising aerosol-forming substrate, or, for example, loose tobacco mixed with a gelling agent or sticky agent, which could include a common aerosol former such as glycerine, and which is compressed or molded into a plug.

In general, the article may have a substantially rod shape, preferably resembling the shape of conventional cigarettes. As to this, the article may further comprise different portions, in particular a core portion, a tubular periphery portion surrounding the core portion and a distal tip portion. In addition, the article may comprise a filter plug at a proximal end serving as mouthpiece. The article may further comprise a wrapper surrounding at least the core portion, the tubular periphery portion and the distal tip portion, and preferably also the filter plug. Primarily, the wrapper serves to keep the different portions together and to maintain the desired cross-sectional shape of the article. For example, the wrapper may be a paper wrapper, in particular a paper wrapper made of cigarette paper. Alternatively, the wrapper may be a foil, for example made of metal or plastics. The wrapper may fluid permeable such as to allow vaporized aerosol-forming substrate to be released from the article, are to allow air to be drawn into the article through its circumference. The wrapper may be porous. Furthermore, the wrapper may comprise at least one volatile substance to be activated and released from the wrapper upon heating. For example, the wrapper may be impregnated with a flavoring volatile substance.

Preferably, the distal tip portion is substantially heated by the bottom portion of the heating chamber, whereas the tubular periphery portion is substantially heated by the sleeve portion of the heating chamber.

In order to provide a larger variety of user experiences, the tubular periphery portion may comprise a first aerosol-forming substrate, preferably including a first sensorial medium, and the distal tip portion may comprise a second aerosol-forming substrate, preferably including a second sensorial medium. Each of the first and second aerosol-forming substrates and/sensorial medium may be chosen to be thermally released at specific first and second temperatures of the first and second heater, respectively.

The core portion may be separated from the tubular periphery portion by an aerosol-tight separation sleeve. Thus, the article may provide different compartments, for example such that aerosol generated in the distal tip portion does not mix with aerosol generated in the tubular periphery portion. Accordingly, the article may comprise two main air paths: an air path through the core portion dedicated for air generated in the distal tip portion, and air path outside the core portion, that is, through the tubular periphery portion which is dedicated for aerosol generated in the tubular periphery portion.

The core portion may be hollow. Alternatively, the core portion may comprise another (third) aerosol-forming substrate, preferably including another (third) sensorial medium.

The density of the aerosol-forming substrates in the different portions of the forming article may be different such as to provide different portions with different resistance-to-draw. For example, the article may have a first aerosol-forming substrate in the tubular periphery portion (preferably including a first sensorial medium), and a second aerosol-forming substrate in the core portion (preferably including a third sensorial medium), wherein the first aerosol-forming substrate has a higher resistance-to-draw than the third aerosol-forming substrate. Accordingly, air passing through the article has a higher velocity in the core portion than in the tubular periphery portion. In particular, such configuration allows aerosol generated in the tubular periphery portion to be drawn into the core portion where it can directly pass towards the proximal end of the article into a user's mouth.

Furthermore, it is possible that the distal end portion of the article may be dipped in specific sensorial medium, for example a liquid or powder or the like, and subsequently inserted into the heating chamber. There, the impregnated distal end portion of the article is in thermal proximity to or even contact with the heated bottom portion of the heating chamber. As the bottom portion can be heated to a temperature different from the temperature of the sleeve portion, in particular independently from a temperature of the sleeve portion, the sensorial medium within the distal end portion can be selectively released at its specific releasing temperature, in particular independently from a sensorial medium and/or aerosol-forming substrate in other portions of the article having a different releasing temperature.

BRIEF DESCRIPTION OF THE DRAWINGS

In addition, the tubular periphery portion, the core portion and/or the distal tip portion may each be divided into respective sub-portions. Each sub-portion preferably is dedicated to a different aerosol-forming substrate and/or different sensorial medium. Such a configuration preferably is used in combination with a first and/or second heater comprising a plurality of first or second heating elements, respectively, as described above. Advantageously, this enables to further increase the variety of a user experience.

Further features and advantages of the aerosol-generating system according to the invention have been described above with regard to the heating assembly and the aerosol-generating device according to the invention and as described herein. Therefore, these further features and advantages will not be repeated.

DETAILED DESCRIPTION

Figure 1:
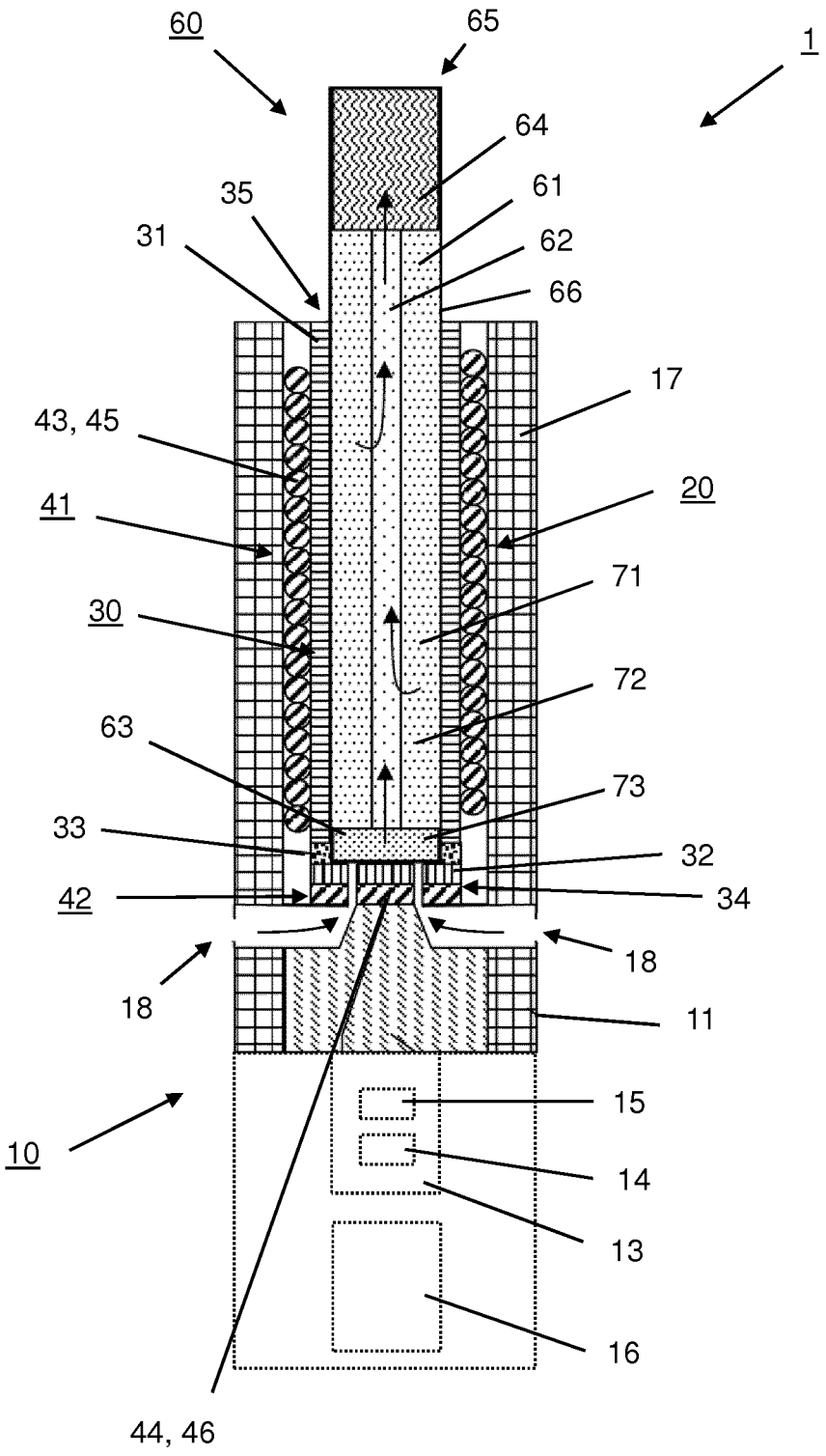
Figure 2:
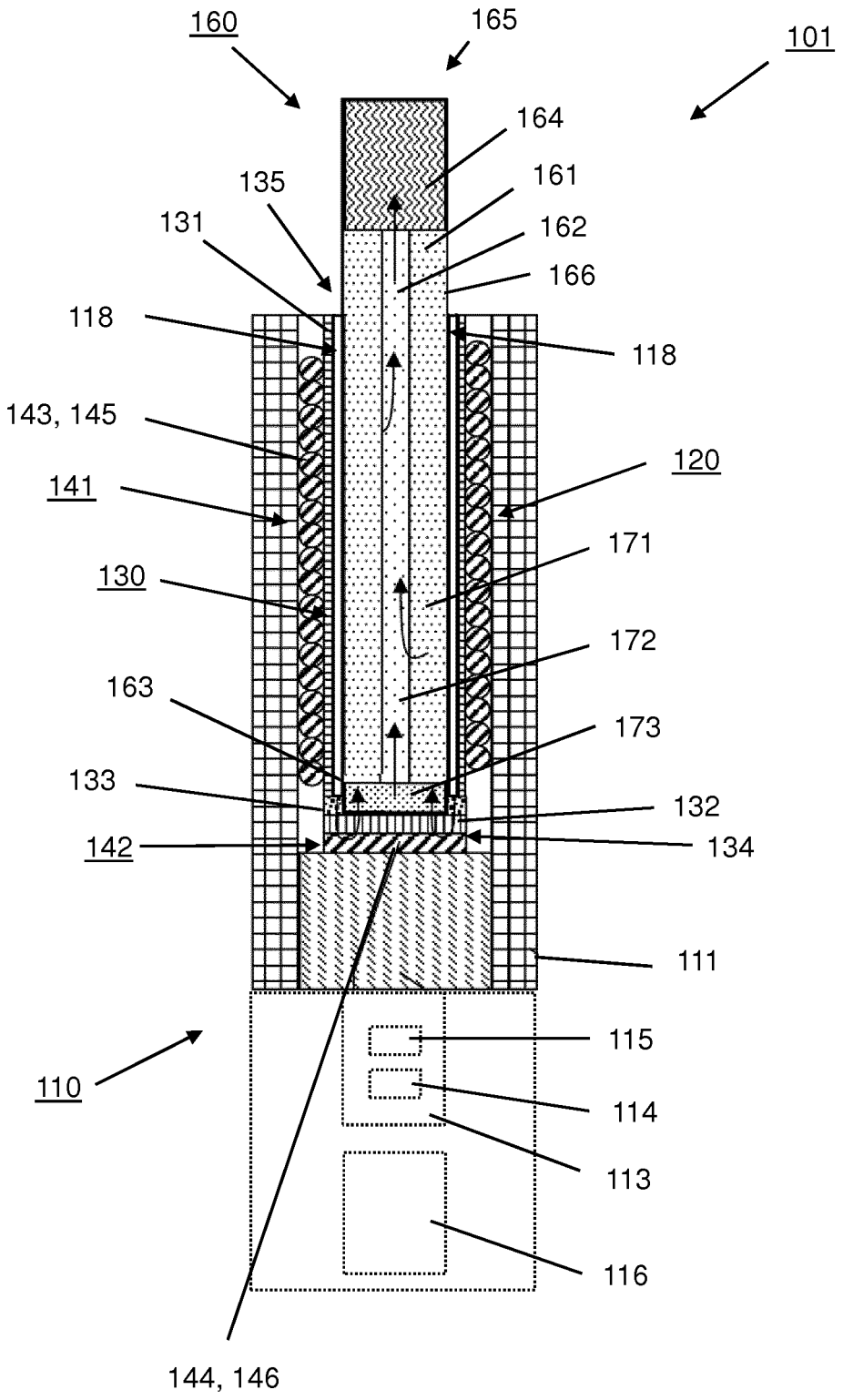

The invention will be further described, by way of example only, with reference to the accompanying drawings, in which:

FIG. 1 is a schematic illustration of an aerosol-generating system comprising an electrical heating assembly according to a first embodiment of the invention;

FIG. 2 is a schematic illustration of an aerosol-generating system comprising an electrical heating assembly according to a second embodiment of the invention;

FIG. 1 schematically illustrates an aerosol-generating system 1 comprising an electrical heating assembly 20 according to a first embodiment of the invention. The aerosol-generating system 1 comprises two components: an aerosol-generating article 60 including aerosol-forming substrate 71, 72, 73 to be heated, and an aerosol-generating device 10 comprising the electrical heating assembly 20 for heating the aerosol-forming substrate 71, 72, 73 within the article upon receiving the article 60 in the device 10.

The aerosol-generating article 60 has substantially rod shape resembling the shape of a conventional cigarette. As can be seen in FIG. 1, the article 60 comprises different portions: a core portion 62, a tubular periphery portion 61 surrounding the core portion 62, and a distal tip portion 63, as well as a filter plug 64 at a proximal end 65 of the article 60 which serve as mouthpiece. The article 60 further comprises a wrapper 66 surrounding at least the core portion 62, the tubular periphery portion 61 and the distal tip portion 63, and preferably also the filter plug 64.

The distal tip tubular periphery portion 61 comprises a first aerosol-forming substrate 71 including a first sensorial medium, the distal tip portion 63 comprises a second aerosol-forming substrate 73 including a second sensorial medium, and the core portion 62 comprises a third aerosol-forming substrate 72 including a third sensorial medium. Preferably, the aerosol-forming substrates 71, 72, 73 differ from each other such as to have, for example, different flavors. In particular, each of the first, second and third aerosol-forming substrates 71, 72, 73 has a specific releasing temperature at which in the respective substrates release of volatile compounds that can form an aerosol is thermally activated. Preferably, the specific releasing temperatures of at least two of the three aerosol-forming substrates 71, 72, 73 differ from each other such that release of the respective volatile compounds may be selectively activated by applying different heating temperatures to the substrates. In the present embodiment, the first and third aerosol-forming substrates 71, 72 have substantially the same releasing temperatures, whereas the second aerosol-forming substrate 73 has a significantly higher releasing temperature. Moreover, each of the first, second and third aerosol-forming substrates 71, 72, 73 may provide a specific resistance-to-draw. In the present embodiment, the first aerosol-forming substrate 71 has a much higher resistance-to-draw than the second and third aerosol-forming substrates 72, 73. Accordingly, air passing through the article 60 has a higher velocity in the core portion 62 than in the tubular periphery portion 61. As a result, aerosol generated in the tubular periphery portion is drawn into the core portion where it can directly pass towards the proximal end 65 of the article 60 into a user's mouth. In FIG. 1, this effect is illustrated by arrows representing the airflow through the device 10 and the article 60.

In order to tap the full potential of the different substrates 71, 72, 73 associated to the specific article portions 61, 62, 63, the heating assembly 20 according to the present invention comprises a cup-shaped heating chamber 30 for receiving the aerosol-generating article 60 at least partially therein. The heating chamber 30 comprises a sleeve portion 31 and a bottom portion 32 that is arranged at a distal end 34 of the heating chamber 30 opposite to an open proximal end 35 of the heating chamber 30. Thus, the sleeve portion 31 and a bottom portion 32 substantially form the heating chamber 30 into which the article 60 can be inserted via the open proximal end 35. In the embodiment shown in FIG. 1, the heating chamber 30 has a substantially cylindrical shape including a circular cross-section. That is, the sleeve portion 31 forming the side walls of the cup-shaped heating chamber 30 substantially is a cylindrical tube, whereas the bottom portion 32 substantially is a circular disc.

The heating assembly 20 further comprises a first electrical heater 41 that is configured for heating the sleeve portion 31 to a first temperature. For this, the first heater 41 includes a first heating element 43 that is circumferentially arranged around the sleeve portion 31. Likewise, the heating assembly 20 comprises a second electrical heater 42 that is configured for heating the bottom portion 32 to second temperature. The second heater 42 includes a second heating element 44 that is arranged at an outer end face of the bottom portion 32. Accordingly, the distal tip portion 63 is substantially heated by means of the bottom portion 32 which in turn is heated by the second heater 42, whereas the tubular periphery portion 61 and the core portion 62 are substantially heated by means of the sleeve portion 31 which in turn is heated by the first heater 41.

In the present embodiment, the first and second heaters 41, 42 are inductive heaters configured to generate an electromagnetic field for inductively heating the sleeve portion 31 and the bottom portion 32, respectively. Accordingly, the first heating element 43 comprises a helical first induction coil 45 that is circumferentially arranged around the sleeve portion 31 and extends substantially along the full length extension of the sleeve portion 31. Likewise, the second heating element 44 comprises a second induction coil 46 which is a flat pancake coil arranged at the outer end face of the bottom portion 32. Both, the sleeve portion 31 and the bottom portion 32 of the heating chamber 30 comprise an inductively heatable material in which the respective alternating electromagnetic field generates at least one of heat generating eddy currents or hysteresis losses, depending on electrical and magnetic properties of the respective inductively heatable material. Thus, the sleeve portion 31 serves as a first susceptor element that is inductively heated by the first induction coil 45 and the bottom portion 32 serves as a second susceptor element that is inductively heated by the second induction coil 46. In the present embodiment, the sleeve portion 31 and the bottom portion 32 are both made of the same type of ferromagnetic stainless steel. However, it is also possible that the sleeve portion 31 and the bottom portion 32 comprise or consist of different inductively heatable materials. Advantageously, this facilitates heating the sleeve portion 31 and the bottom portion 32 and thus the different portions within the article 60 to different temperatures.

In the present embodiment, the first and second electrical heaters 41, 42 are configured for being operated independently from each other. That is, each one of the first and second electrical heaters 41, 42 are associated to and run by a separate controller 14, 15 configured to control operation of a respective heater independently from the respective other heater. Both controllers 14, 15 may be part of or subunits of an overall controller 13 of the aerosol-generating device 10. Each of the two controllers 14, 15 include an AC generator (not shown in FIG. 1) that is configured to provide a high frequency oscillating current having a frequency between 500 kHz and 30 MHz. For providing the AC currents to the induction coils, the controllers 14, 15 are operatively coupled by wire (not shown in FIG. 1) with the first and second induction coil 45, 46, respectively. The controllers 13, 14, 15 are powered by a rechargeable power supply 16, for example a lithium iron phosphate battery.

With regard to a fully independent control of the first and second heating temperatures of the sleeve portion 31 and the bottom portion 32, the controllers 14, 15 are configured to generate and provide the respective high frequency oscillating currents for operating the first and second induction coil 45, 46 at different frequencies and/or different amplitudes and/or different times. The high frequency oscillating current for operating the first induction coil 45 may differ from the high frequency oscillating current for operating the second induction coil 46 with regard to frequency and/or amplitude and/or time and duration. Advantageously, this enables to heat the sleeve portion 31 and the bottom portion 32 to different temperatures and/or at different times and/or for different durations. Thus, the first, second and third aerosol-forming substrates—which preferably include different flavors—may be activated at different times and/or different intensities and/or for different durations which largely increases the variety of the user's experience.

To facilitate independent heating of the sleeve portion 31 and the bottom portion 32, in particular in order to prevent thermal interference between the sleeve portion 31 and the bottom portion 32, the heating chamber 30 comprises a thermally insulating ring 33 arranged between the sleeve portion 31 and the bottom portion 32.

As can be seen in FIG. 1, the heating assembly 10—including the sleeve portion 31, the bottom portion 32 and the insulating ring 33 of the heating chamber 30—as well as the controllers, 13, 14, 15 and the power supply 16 are arranged within a housing 11 of the aerosol-generating device 10. Within the housing 11, the device 10 further comprises a thermally insulating material 17 at the periphery of the heating assembly 10 which advantageously prevents a user to be burnt when holding the device 10.

As can be further seen in FIG. 1, the device 10 comprises an air path extending from lateral air inlets 18 in the device housing 11 through openings 38 in the bottom portion 32 into the inner void of the heating chamber 30. From there, the air path continues via the distal tip portion 63 through the article 60 all along its length extension up to the filter plug 64 at the proximal end 65 of the article 60. As explained above, the air path through the article of the present embodiment primarily extends through the center of the article 60, in particular through the core portion 62 which provides a lower resistance-to-draw than the tubular periphery portion 61.

In use, a user may press a button (not shown in FIG. 1) to select and activate a specific heating sequence out of a plurality of different heating sequences or operation modes. Depending on the specific heating sequence selected by the user, the controllers 14, 15 provide a high frequency oscillating current to the first and/or second induction coil 45, 46 such as to generate a respective alternating electromagnetic field within the sleeve portion 31 and the bottom portion 32. As a consequence, the sleeve portion 31 and/or the bottom portion 32 heat up due to eddy currents and/or hysteresis losses that are induced by the respective alternating electromagnetic field, depending on the magnetic and electric properties of the material of the sleeve portion 31 and the bottom portion 32, respectively. The please portion 31 and/or the bottom portion 32 heats up until reaching the first or second heating temperatures. These temperatures are chosen with regard to the specific aerosol-releasing temperatures of the associated first, second or third aerosol-forming substrate within the tubular periphery portion 61, the core portion 62 and the distal tip portion 64. Preferably after a certain heat-up time, the user may puff on the filter plug 64—serving as mouthpiece—to draw air though the air inlets 18 into the heating chamber 13 and further through the article 60 into the user's mouth. Depending on the specific heating sequence and the specific point in time within in the sequence selected, vaporized aerosol-forming material released from the tubular periphery portion 61, the core portion 62 and/or the distal tip portion 64 is entrained in the air flowing from the distal tip portion 64 substantially along the central air path in the core portion 62 towards the proximal end 65 of the article 60. Along this way, the vaporized aerosol-forming material cools to form an aerosol before escaping through the filter plug 64 into the user's mouth.

Depending on the specific heating sequence, the controllers 14, 15 power the first and second heater 41, 42 at a predetermined time and for a predetermined duration. For example, a specific heating sequence may provide a sequential heating of different substrate portions 71, 72, 73 within the aerosol-generating article 60 dedicated to different flavors. Another heating sequence may provide heating of different substrate portions 61, 62, 63 within the aerosol-generating article 60 at different intensities, possible varying over time. Yet another heating sequence may provide heating of different substrate portions 61, 62, 63 within the aerosol-generating article 60 at different temperatures, wherein the different substrate portions 61, 62, 63 may either include the same aerosol-forming substrate or different aerosol-forming substrates 71, 72, 73.

Furthermore, it may be possible that the aerosol-generating device 10 is configured for customized modification of a heating sequence by a user or the provider of the device. A heating sequence may be modified, for example, via a user interface at the device that is operatively coupled with the controllers 13, 14, 15, and/or remotely by wireless or wire-bound connection using an external device, such as a personal computer or a mobile phone, for example a smartphone.

FIG. 2 schematically illustrates an aerosol-generating system 101 comprising an electrical heating assembly 120 according to a second embodiment of the present invention. The system 101 shown in FIG. 2 is very similar to the system 1 shown in FIG. 1, in particular with regard to the aerosol-generating articles 60, 160 and the aerosol-generating devices 10,110. The aerosol-generating articles 60, 160 are even identical. Therefore, like or identical features are denoted with the same reference numerals as in FIG. 1, incremented by 100. Yet, in contrast to the aerosol-generating device 10 according to FIG. 1, the device 110 according to FIG. 2 does not comprise lateral air inlets at the circumference of the device housing. Instead, the sleeve portion 131, the bottom portion 132 and the thermally insulating ring 133 of the heating chamber 130 comprise a plurality of slots or grooves at their respective inner surface which extend from the proximal end 135 of the heating chamber 130 to the bottom portion 132 and further along the inner side of the bottom portion such as to provide a plurality of airflow passages between the proximal end 135 of the heating chamber 130 and the inner side of the bottom portion 132 facing the distal tip end 163 of the article 160 that is inserted into the heating chamber 130. Accordingly, when a user puffs on the filter plug 164 of the article 160, ambient air is drawn-in at the proximal end 135 of the heating chamber 130 and further passes along the plurality of slots or grooves into the distal tip end 163 of the article 160. When passing along the plurality of slots or grooves, the ambient air is thus pre-heated by the sleeve portion 132 and the bottom portion 132 which beneficially affects the aerosol formation.

The invention claimed is:

1. An electrically heating aerosol-generating device comprising a heating assembly for heating an aerosol-forming substrate, the heating assembly comprising:

a cup-shaped heating chamber configured to receive the aerosol-forming substrate to be heated, wherein the cup-shaped heating chamber is formed at least by a sleeve portion and a bottom portion that is disposed at a distal end of the cup-shaped heating chamber opposite to an open proximal end of the cup-shaped heating chamber;

a first electrical heater including at least one first heating element circumferentially arranged around the sleeve portion and being configured to heat the sleeve portion at least to a first temperature; and a second electrical heater including at least one second heating element arranged at an outer end face of the bottom portion and being configured to heat the bottom portion at least to a second temperature, wherein the at least one first heating element comprises a first induction coil and the sleeve portion includes an inductively heatable material, wherein the at least one second heating element comprises a second induction coil and the bottom portion includes inductively heatable material, wherein the first heating element extends beyond the sleeve portion to surround the bottom portion, and wherein an inductance of the first induction coil is different from an inductance of the second induction coil.

2. The electrically heating aerosol-generating device according to claim 1, wherein the first electrical heater and the second electrical heater are configured for being operated independently from each other.

3. The electrically heating aerosol-generating device according to claim 1, wherein the cup-shaped heating chamber further comprises a thermally insulating ring disposed between the sleeve portion and the bottom portion.

4. The electrically heating aerosol-generating device according to claim 1, wherein the cup-shaped heating chamber is cylindrical or frustum-shaped.

5. The electrically heating aerosol-generating device according to claim 1, wherein at least one of the bottom portion or the sleeve portion is fluid-permeable, comprising at least one opening and/or is perforated.

6. The electrically heating aerosol-generating device according to claim 1, wherein the sleeve portion includes a first material and the bottom portion includes a second material different from the first material.

7. The electrically heating aerosol-generating device according to claim 6, wherein at least one of an electrical resistivity, a magnetic permeability, or a specific heat of the first material of the sleeve portion is different from an electrical resistivity, a magnetic permeability, or a specific heat of the second material of the bottom portion, respectively.

8. The electrically heating aerosol-generating device according to claim 1, wherein the first induction coil is spaced apart from the sleeve portion such that a minimum distance between the first induction coil and the sleeve portion is 0.05 to 0.3 mm.

9. The electrically heating aerosol-generating device according to claim 1, wherein the second induction coil is spaced apart from the bottom portion such that a minimum distance between the second induction coil and the bottom portion is 0.05 to 0.3 mm.

10. An aerosol-generating system, comprising an electrically heating aerosol-generating device according to claim 1; and an aerosol-generating article receivable in the heating chamber of the heating assembly, the aerosol-generating article including at least one aerosol-forming substrate configured to be heated.

11. The aerosol-generating system according to claim 10, wherein the aerosol-generating article has a substantially rod shape comprising a core portion, a tubular periphery portion surrounding the core portion, and a distal tip portion, and wherein the tubular periphery portion includes a first aerosol-forming substrate and the distal tip portion includes a second aerosol-forming substrate.

12. The aerosol-generating system according to claim 11, wherein the core portion is hollow or includes a third aerosol-forming substrate.

13. The aerosol-generating system according to claim 11, wherein the core portion is separated from the tubular periphery portion by an aerosol-tight separation sleeve.

* * * * *